United States Patent [19]

Roser

[11] 4,349,085

[45] Sep. 14, 1982

[54] OIL LUBRICATION SYSTEM

[76] Inventor: Erich Roser, Dorfstrasse 17, Salem-Grasbeuren, Fed. Rep. of Germany, D-7777

[21] Appl. No.: 180,988

[22] Filed: Aug. 25, 1980

[30] Foreign Application Priority Data

Sep. 8, 1979 [DE] Fed. Rep. of Germany ..... 2936374

[51] Int. Cl.[3] ..... F01M 1/02

[52] U.S. Cl. ..... 184/6.15; 66/8; 139/1 R; 184/26

[58] Field of Search ..... 66/8; 139/1 R; 112/256; 184/6.15, 6.14, 6.28, 6, 26, 27 A, 27 C, 67, 103 A

[56] References Cited

U.S. PATENT DOCUMENTS

| | | | |
|---|---|---|---|
| 1,541,866 | 6/1925 | Sorensen | 184/103 A |
| 1,542,912 | 6/1925 | Rockwell | 184/103 A |
| 1,595,292 | 8/1926 | Davis | 184/27 A X |
| 1,704,179 | 3/1929 | De Forest | 184/67 X |
| 1,763,961 | 6/1930 | Gits | 184/67 X |
| 2,382,426 | 8/1945 | Kocher | 184/26 X |
| 3,078,960 | 2/1963 | Minton | 66/8 X |
| 3,561,565 | 2/1971 | Woor et al. | 66/8 X |
| 3,570,629 | 3/1971 | Dahm et al. | 184/103 A |
| 4,205,708 | 6/1980 | Burgbacher | 139/1 R |

FOREIGN PATENT DOCUMENTS

| | | | |
|---|---|---|---|
| 1295376 | 5/1969 | Fed. Rep. of Germany | 184/26 |

*Primary Examiner*—David H. Brown

*Attorney, Agent, or Firm*—Amster, Rothstein & Engelberg

[57] ABSTRACT

This invention is directed to an oil lubrication system for lubricating the beds of knitting machines. This is provided by individual intermittently functioning plunger pumps operated by electronic switching arrangements for individual adjustment to prevent clogging.

5 Claims, 3 Drawing Figures

OIL LUBRICATION SYSTEM

Figure 1:
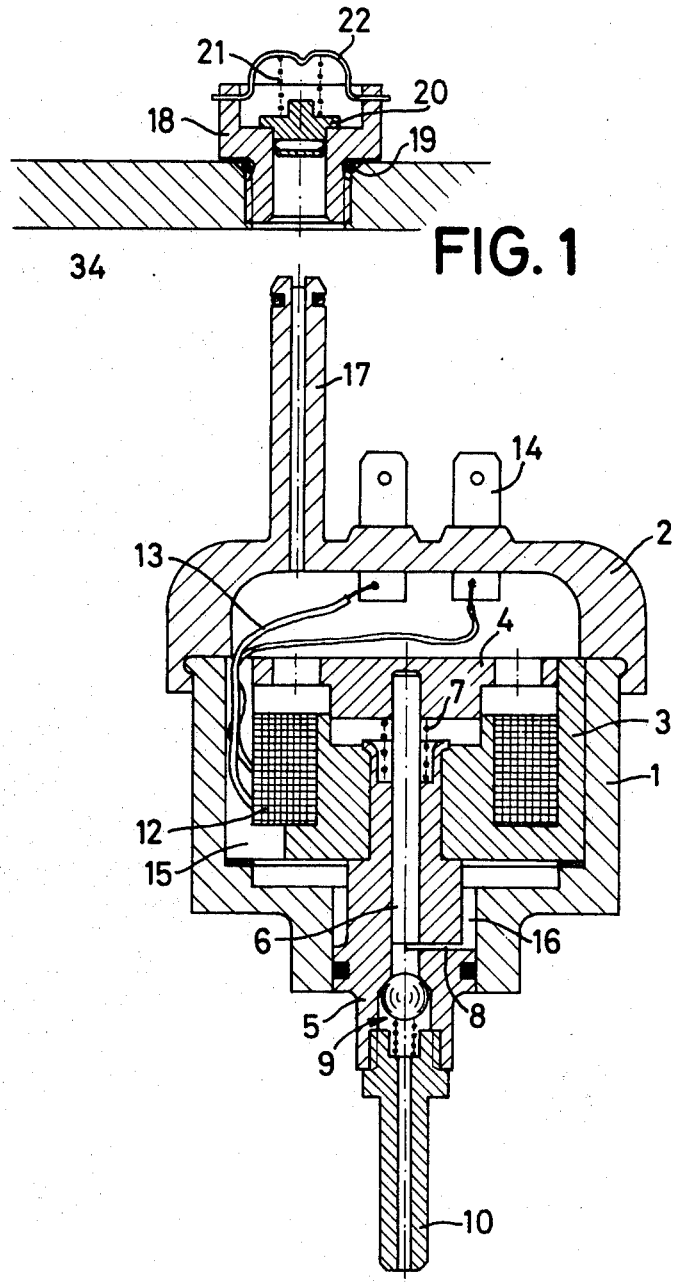

So-called gravity oilers, in which the transport of the comparatively fluid oil occurs as a result of the static pressure, are known for lubricating the needle beds of knitting machines. The oil flow rate is adjusted by enlarging or reducing a passage orifice or is apportioned by means of scoops mounted on a common shaft, the rotary speed of the shaft being variable. It is a disadvantage that these gravity oilers very easily become clogged due to fouling, so that they feed less oil than adjusted, or no oil at all. The flow rate adjustment demands extraordinary dexterity and is also extremely imprecise.

So-called spray oilers, in which the oil is finely atomized at high pressure, generally in the region of a plurality of lubrication points, are also very widespread. But in this case oil mists are produced which can result in danger to the health of the people working, especially in large machine shops.

Central lubrication systems with feed pumps, the delivery rate of which is mechanically adjustable, e.g. by modifying the stroke of plunger pumps, are also known from general mechanical engineering. However, these are always complicated and voluminous units, which also have the disadvantage that the delivery rate actually adjusted cannot be correctly monitored. It is therefore necessary, for vital lubrication points, to provide free fall paths in a glass vessel as drop counters.

The underlying aim of the invention is to propose an oil lubrication system particularly suitable for knitting machines, which permits an easy, precise and also individual adjustment of the quantity of oil per unit of time fed to the individual lubrication point, feeds this oil under pressure, maintains the feed rate constant as long as desired, and is also inexpensive and adaptable.

This aim is achieved according to the invention by individual intermittently electromagnetically operable plunger pumps and electronic switching arrangements, associated with the latter, which generate current impulses each producing one plunger stroker, and the impulse frequency of which is adjustable.

Magnetic pumps of this type can be produced in extremely small sizes and cheaply. Thanks to modern electronics, the switching arrangements for the impulse control of the pumps also require only small financial outlay and little space. The switching arrangements are all mutually identical, so that one can be associated with each individual pump, so that each lubrication point can be individually adjusted. The pumps are fed with a safe low tension and can be arranged within a large machine directly at the lubrication point, or combined in groups to form sub-assemblies. Clogging is practically impossible, because even a small pump with a small stroke volume of only a few cubic millimeters is capable of generating a very high pressure.

To enable the oil pipes to be filled rapidly at the time of taking into service, it is proposed that each switching arrangement exhibits a particular switching member for manual operation with maximum possible impulse frequency.

The plunger pumps preferably have a shielded electromagnet with disc-shaped armature, a cylinder arranged coaxially in the core region of the magnet and a striker plunger, whilst a lateral orifice travelled over by the plunger is provided as admission valve, and a ball valve at the cylinder end face as discharge valve.

For many applications, e.g. on circular knitting machines, it is convenient to combine a plurality of plunger pumps with the electronic switching arrangements and with an oil reservoir to form a sub-assembly. In order to fulfil all requirements in these circumstances, such sub-assemblies must be demountable. It is therefore proposed that the electronic switching arrangements are constructed as plug-in cards and the plunger pumps exhibit electrical plug pins and a plug-in admission pipe connection pointing in the same direction, which lodges in, and simultaneously opens, a self-closing connection mouthpiece arranged at the base of the reservoir when the electrical plug pins are engaged into corresponding sockets of the sub-assembly. From the standpoint of economical production, appropriate sheet-metal housings, each with an oil reservoir, may be prepared in uniform size. These housings are then equipped with plug-in pumps and switching arrangements according to requirements. It is not unusual, in large knitting shops in the textile industry, to find over a hundred knitting machines with innumerable lubrication points. The proposed system is found to be extraordinarily adaptable and therefore economical under such conditions.

In the case of major oil consumption it is frequently desirable to relieve the staff also of the work of refilling the oil reservoirs. This is possible in that the oil reservoirs are automatically refillable through a permanently pressurized feed pipe, each by means of a float-operated valve. The oil reservoirs may also be subdivided by partition walls and thus equipped for different types of oil.

Figure 2:
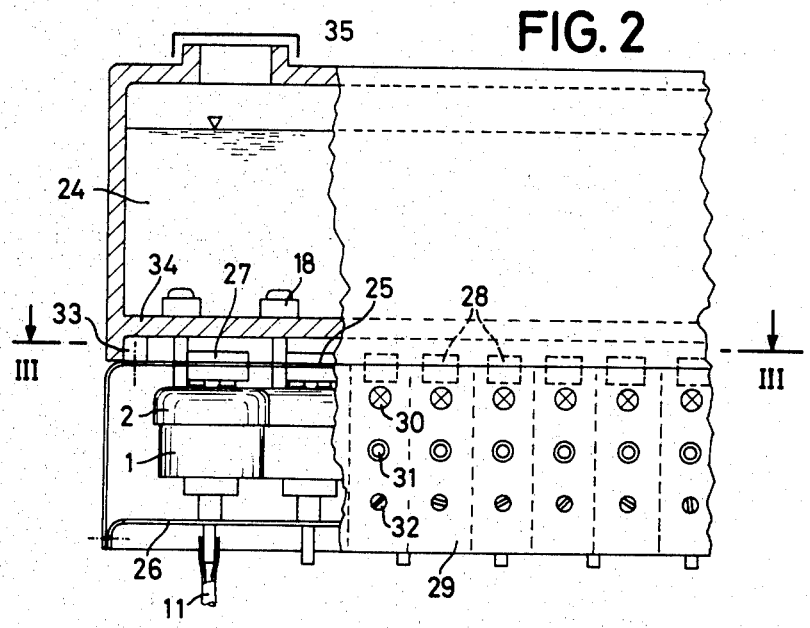
Figure 3:
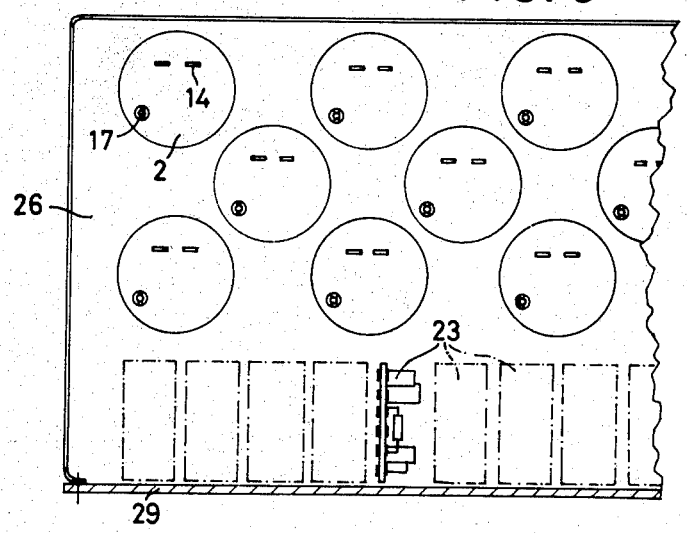

An exemplary embodiment of the invention is explained more fully hereinbelow with reference to the accompanying drawing, wherein:

FIG. 1 shows a longitudinal section of an electronically operated plunger pump to a scale of 2:1, FIG. 2 shows the elevation of a partly fragmented group oiler to a smaller scale and FIG. 3 shows a horizontal section III—III of the group oiler according to FIG. 2.

The pump according to FIG. 1 comprises a housing 1 with tight snap-on cover 2, in which a shielded electromagnet 3 with armature 4 is present. A brass cylinder piece 5, in which a striker plunger 6 is mounted, is flanged into the core region of the shielded electromagnet 3. This striker plunger is inserted by its upper end into the armature 4 and is urged into the illustrated upper position by a return spring 7. Level with the lower piston end (according to FIG. 1) the cylinder piece 5 exhibits a transverse slit 8. The interior of the cylinder is closed at the lower end by a ball valve 9. A hose mouthpiece 10 screwed into the cylinder piece 5 from beneath retains the spring of the ball valve 9 and serves for plugging on a hose 11 (FIG. 2), which connects the pump to a lubrication point.

The excitation winding 12 of the shielded electromagnet is connected by wires 13 to two plug contacts 14 inserted tightly into the cover 2. The wires 13 are laid in a longitudinal slit 15 of the shielded electromagnet. This longitudinal slit 15 simultaneously constitutes a communicating channel between the space above the armature 4 and a ring space 16 into which the transverse slit 8 opens.

A plug-in pipe 17 standing upwards parallel to the plug contacts 14 is shaped onto the cover 2. It carries at its upper end an O ring, by which it is insertible into the central bore of a connection mouthpiece 18 which is screwed into the base of an oil reservoir which is explained more fully in connection with FIG. 2. The screw connection is sealed by an O ring 19. A stopper 20, which is likewise fitted with an O ring and inserted from above into the bore of the connection mouthpiece 18, is urged downwards by a spring 21. This spring is braced against a stirrup 22 of the connection mouthpiece.

The FIGS. 2 and 3 clearly show how a plurality of the plunger pumps described, and electronic plug-in cards associated with the latter, in a sheet-metal housing with an oil reservoir 24 are combined into a sub-assembly, a so-called group oiler. The sheet-metal housing is composed of a downwardly open top section with a roof 25 and a base 26 inserted from beneath. The roof 25 has holes into which plug fittings 27 for the plug contacts 14 of the pumps and plug fittings 28 for the plug-in cards 23 are inserted. These plug fittings 27 and 28 are wired together above the roof 25. The hose mouthpieces 10 project out of the sheet-metal housing downwards through the base 26.

The sheet-metal housing is closed towards the front by a face plate 20. Immediately behind the latter, the plug-in cards 23 are arranged upright, so that an indicator lamp 30, a push button 31 and an adjusting screw 32 of each plug-in card project forward and are visible and accessible through the face plate 29.

An oil reservoir made of transparent plastic, the base of which, designated 34, has already been mentioned during the description of FIG. 1, is screwed by distance blocks 33 onto the sheet-metal housing described. The refilling orifice of the oil reservoir 24 is closed by a cap 35.

The oil lubrication system described operates as follows. The oil contained in the oil reservoir 24 passes through the open connecting mouthpieces 18 and the plug-in pipes 17 into the plastic housings of the individual pumps. This oil flows through the longitudinal slits 15, the ring chambers 16 and the transverse slits 8 into the cylinder interiors. When the relevant excitation winding 12 receives a current impulse, the relevant armature 4 moves the striker plunger 6 downwards. The latter closes the transverse slit 8 and forces a volume of oil, amounting to only a few cubic millimeters, downwards and through the hose 11 to the lubrication point, whilst the ball valve 9 opens.

The relevant indicator lamp 30 lights up at each current impulse, by which means the impulse frequency, and accordingly the oil feed rate, are indicated. By turning the adjusting screw 32 of the relevant plug-in card with a screwdriver the impulse frequency can be adjusted quite accurately. When the associated push button 31 is depressed, the switching arrangement operates at maximum impulse frequency, which corresponds e.g. to 10 strokes per second. In this way the hose lines, which are initially empty, can be filled rapidly at the time of installation.

It is of course not necessary to use all the plug fittings 27 and 28 in the housing described. On the contrary, only those pumps and plug-in cards required for the relevant machine need be included. When pumps are removed the stoppers 20 of the relevant connection mouthpieces 18 completely reseal the oil reservoir. In this way the described system is adaptable for all service conditions encountered with a minimum of outlay.

But furthermore, the magnetic pumps can also be used individually. For example, a magnetic pump may be screwed directly onto the component to be lubricated, in which case the installation position is not important. In this case an admission hose and a thin electric cable are taken to the lubrication point.

I claim:

1. An oil lubricating system particularly for use in delivering lubricating oil to a plurality of lubricating points in a knitting machine, comprising: an oil reservoir containing a bulk quantity of lubricating oil, a plurality of individually operable lubricating pumps at least equal in number to the number of lubricating points for applying lubricating oil to the individual points in the knitting machine, each of said pumps including oil inlet means communicating with said oil reservoir to permit a quantity of lubricating oil to be conveyed to the interior of said pump, oil outlet means through which lubricating oil is conveyed for application to the lubricating point associated with the pump, an electromagnetically-operable plunger means operatively coupled to said oil outlet means, said plunger means being activated periodically to permit a quantity of lubricating oil to be conveyed through said oil outlet means, and means independent of the operation of said knitting machine for controlling the number of activations of said plunger means so that the quantity of lubricating oil delivered to a lubricating point within a preselected time period can be precisely determined and controlled.

2. The oil lubricating system in accordance with claim 1, wherein said means for controlling the number of activations of said plunger means includes a switching member for manually selecting the maximum possible number of activations of said plunger for a preselected time period.

3. The oil lubricating system of claim 1, wherein said oil reservoir includes a plurality of self-closing mouthpieces mounted thereon at least equal in number to the number of lubricating pumps, and said oil inlet means includes an oil admission pipe having a central bore extending from said pump and received in said mouthpiece to permit lubricating oil from said oil reservoir to be conveyed to the interior of said pump through said mouthpiece and central bore of said oil admission pipe.

4. The oil lubricating system according to claim 1, wherein said electromagnetically-operable plunger means includes a shielded electromagnet having a disc-shaped armature, a cylinder having a central bore arranged coaxially in the core region of said electromagnet, a striker plunger slideably mounted in the central bore of said cylinder, the upper end of said striker plunger being fixedly mounted in the armature of said electromagnet, said oil inlet means including a lateral orifice communicating with the central bore of said cylinder in the region below the lower end of said striker plunger when said striker plunger is in its rest position thereby permitting lubricating oil to fill a space in said central bore between the lower end of said striker plunger and said oil outlet means, said striker plunger upon activation of said electromagnetically-operable plunger means being driven downward to seal said lateral orifice and to force a quantity of lubricating oil within the central bore through said oil outlet means.

5. The oil lubricating system in accordance with claim 4, wherein the means for controlling the number of activations of said plunger means are arranged as plug-in cards and said pump includes electrical plug pins which plug into sockets communicating with said plug-in cards.

* * * * *